US006283245B1

(12) United States Patent
Thurman et al.

(10) Patent No.: US 6,283,245 B1
(45) Date of Patent: Sep. 4, 2001

(54) MEDIA FREE SOUND ATTENUATOR

(76) Inventors: William E. Thurman; Roger M. Coday; Prabhanjan Mysore, all of 1800 E. Point Dr., Columbia, MO (US) 65201-3508

( * ) Notice: Subject to any disclaimer, the term of this patent is extended or adjusted under 35 U.S.C. 154(b) by 0 days.

(21) Appl. No.: 08/976,536

(22) Filed: Nov. 21, 1997

Related U.S. Application Data

(60) Provisional application No. 60/031,951, filed on Nov. 27, 1996.

(51) Int. Cl.[7] ..... E04F 17/04
(52) U.S. Cl. ..... 181/224
(58) Field of Search ..... 181/224, 225, 181/229, 264, 282

(56) References Cited

U.S. PATENT DOCUMENTS 4,055,231 * 10/1977 Martinez ..... 181/264
4,287,962 * 9/1981 Ingard et al. ..... 181/224
4,418,788 * 12/1983 Gorchev et al. ..... 181/224
5,473,124 * 12/1995 Yazici et al. ..... 181/224

* cited by examiner

*Primary Examiner*—Khanh Dang
(74) *Attorney, Agent, or Firm*—George Morgan; Gary Price

(57) ABSTRACT

A sheet metal media free sound attenuator reduces noise from machinery and gas flow in duct systems, that has a solid outer shell box and at least one flow passage made of perforated sheet. The flow passage can have a gap called expansion chamber and supports that divide cavity between a wall of the perforated passage and a wall of the outer shell box. Entrance transition and exit transition of the sound attenuator provides smooth flow into the attenuator, reduces pressure drop, and increases attenuation. In the preferred embodiment, the perforated sheet is a perforated spiral sheet.

12 Claims, 11 Drawing Sheets

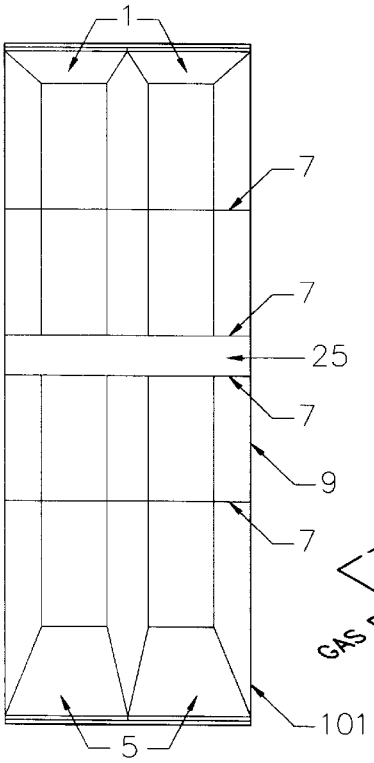
FIG. 2
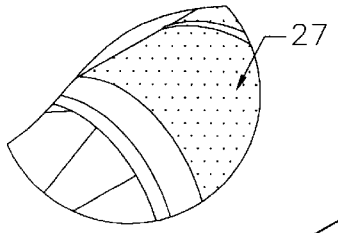
FIG. 1A
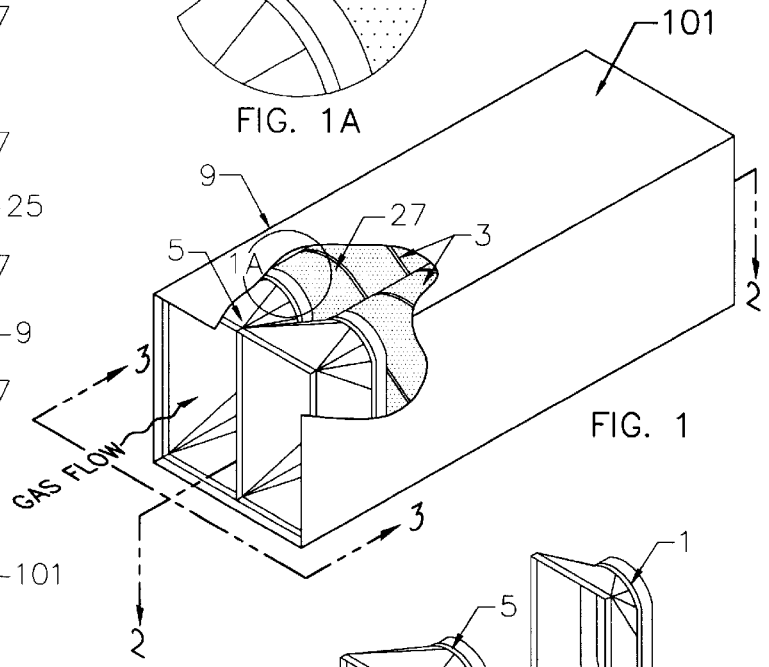
FIG. 1
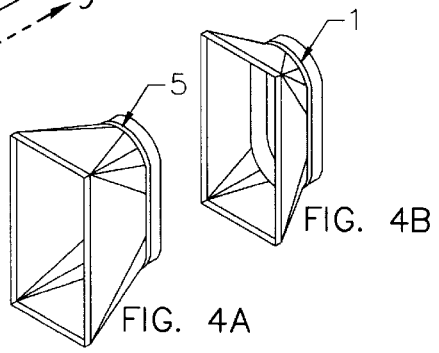
FIG. 4B
FIG. 4A
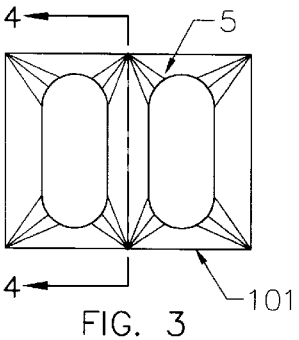
FIG. 3
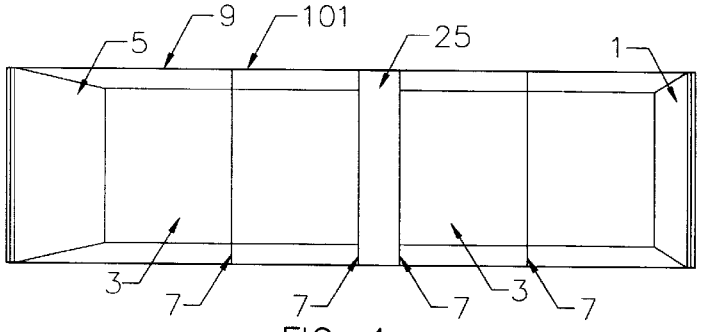
FIG. 4

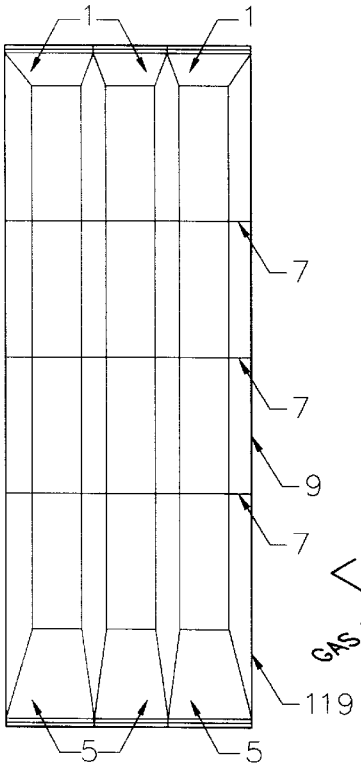
FIG. 36
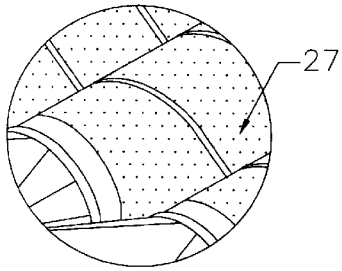
FIG. 35A
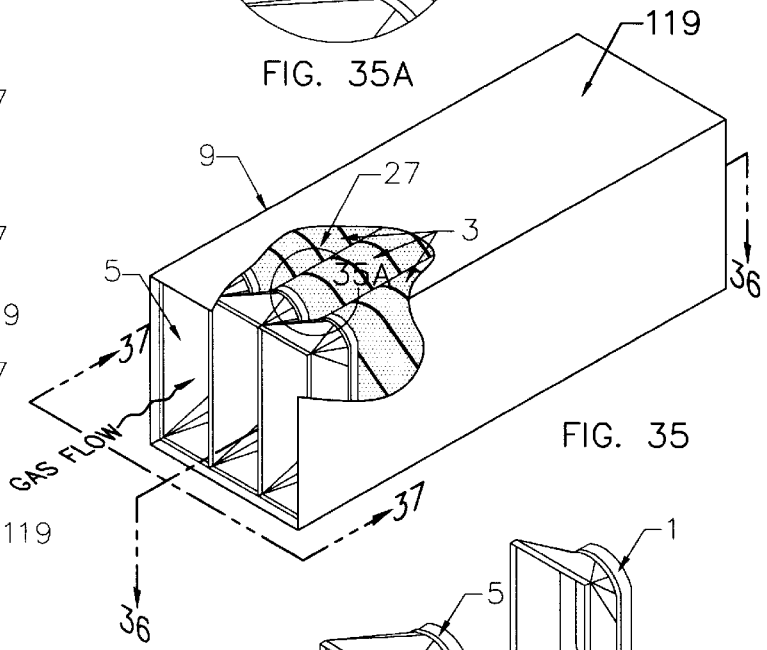
FIG. 35
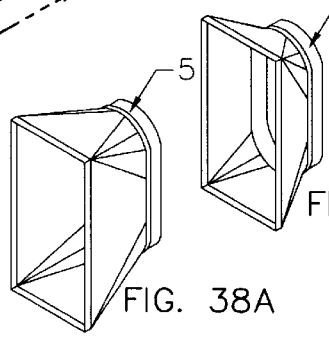
FIG. 38B
FIG. 38A
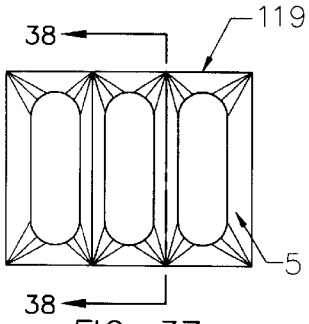
FIG. 37
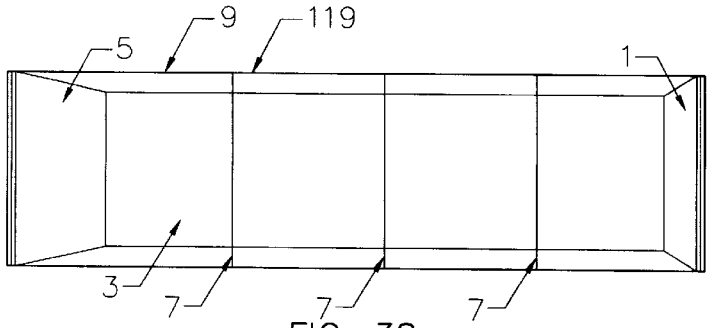
FIG. 38

MEDIA FREE SOUND ATTENUATOR

CROSS REFERENCES TO RELATED APPLICATIONS

This application claims benefit of Provisional Appn 60/031,951 filed Nov. 27, 1996.

BACKGROUND OF THE INVENTION

1. Field of the Invention

This invention relates to the attenuation and reduction of machinery and gas flow noise and turbulence in duct systems including, but not restricted to, heating, ventilating and air conditioning air duct systems.

2. Background Information

Conventional sound attenuators used in duct systems use resistance provided by filler material when sound travels through pores of the filler material. Typically FIBERGLASS, ROCKWOOL, foam and other fibrous materials are used for this purpose. Perforated sheets are used to increase the access of the sound from flow passage to filler material. The filler material that is used to attenuate sound creates some new problems. At higher gas flow velocities the filler material gets eroded into small particles and gets entrained in airflow contaminating indoor air of a facility. The filler materials produce some toxic gases, cause microorganisms to grow or release some hazardous products when they come in contact with some other chemicals. These problems make the use of filler material in sound attenuators dangerous. Pat. No. 4,287,962 Packless Silencer, Ingard et al, Sep. 8, 1981 addresses the above mentioned problems associated with the filler material of fibrous nature. Ingard et al uses sound attenuators with acoustic resistance provided by resistive sheets or perforated face sheets. While sound attenuators having perforated sheets were an improvement, they did not include benefits that round and oval passages inherently have over flat sheets or rectangular shapes. The entrance and exit were not designed optimally and this causes flow noise to increase and often results in turbulence of flow. Turbulent flow increases the energy required to maintain gas flow. These disadvantages led to a less than optimal acoustical and flow performance. As will be seen in the subsequent description, the present invention overcomes these disadvantages of the prior art.

SUMMARY OF THE INVENTION

The present invention is a media free sound attenuator that reduces machinery and gas flow noise and turbulence in duct systems. The present invention uses acoustic impedance of perforated passages and cavities, shape factors of the round/flat-oval passage elements and transitions to effectively reduce machinery and gas flow noise and turbulence in duct systems instead of using fibrous filler material. The present invention includes a metallic shell and at least one perforated liner element that acts like a flow passage. For optimum performance, the liner element is a spriral element. The shell and the liner elements are separated by divider plates, transitions are placed at the entrance and exit of the media free sound attenuator to reduce pressure drop and increase acoustic performance. The expansion chamber is an area discontinuity inside the sound attenuator that adds to the attenuation by reflecting the noise in the lower frequencies. The shape factor of the round and flat-oval passage elements adds to broad band noise attenuation, also the transitions at the entrance and exit are also effective in noise attenuation. All these factors enhance the performance of the sound attenuator in terms of insertion-loss, pressure drop and gas flow generates noise. Also, the improvements included in the present invention reduces turbulence of flow, which reduces horsepower required to maintain then flow. The present invention includes an optional expansion chamber that adds to the acoustic impedance of the sound attenuator.

BRIEF DESCRIPTION OF THE DRAWINGS

In the drawings, closely related figures have the same number but different alphabetical surfaces.

FIGS. 1, 1A, 2, 3, 4, 4A, and 4B show Isometric, Plan, Elevation and Side views of an attenuator with two ovoidal form passages with an expansion chamber.

FIGS. 35, 35A, 36, 37, 38, 38A, and 38B show Isometric, Plan, Elevation and Side views of an attenuator with three ovoidal form passages.

DESCRIPTION OF THE PREFERRED EMBODIMENTS

Figure 6:
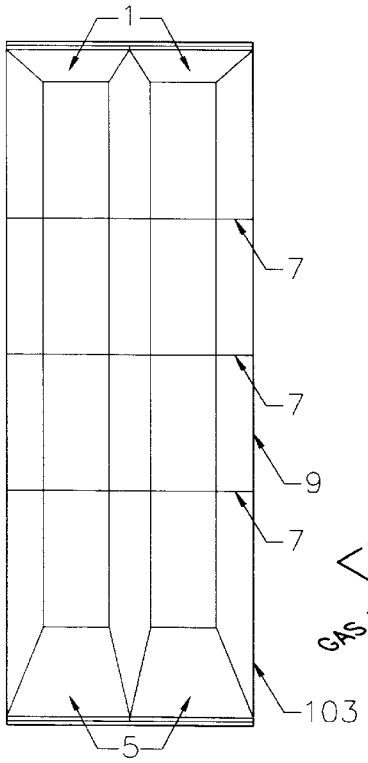

An embodiment of the present invention, a fibrous filler material free sound attenuator 101 is illustrated in FIGS. 1, 1A, 2, 3, 4, 4A, and 4B. FIGS. 1, 1A, 4A, and 4B are isometric views. FIG. 2 is a top view. FIG. 3 is an elevation view. FIG. 4 is a side view. The fibrous filler material free sound attenuator 101 has an outer shell box 9. The outer shell box 9 has entrance transition 5 that directs gas flow from an existing prior art rectangular or square duct (not shown), such as is common to the trade, through two ovoidal form passages 3 of the fibrous filler material free sound attenuator 101, provided by the ovoidal form perforated spiral sheet 27. An arrow indicates the direction of gas flow. The shape of the ovoidal form passages 3 adds to broad band noise attenuation. There is a region between the outer shell box 9 and the ovoidal form passages 3 that is divided into cavities using divider plates 7. The divider plates 7 form cavities containing gas that has seeped through the ovoidal form perforated spiral sheet 27 from the gas flow through the fibrous filler material free sound attenuator 101. The effect of the perforated spiral sheet 27 permitting gas to seep into these cavities results in sound attenuation. A gap in the ovoidal form passage 3, serves as an expansion chamber 25 inside the outer shell box 9. The expansion chamber 25 is an area discontinuity that adds to the sound attenuation by reflecting the noise in the lower frequencies. An exit transition 1 is provided at the other end of the fibrous filler material free sound attenuator 101 for connection to an existing prior art rectangular or square duct (not shown) such as is common to the trade. In the preferred embodiment of the present invention, the ovoidal form passages 3 are provided by the ovoidal form perforated sprial sheet 27. A ovoidal form perforated sheet results in some sound attenuation but the ovoidal form perforated spiral sheet 27 works better.

Figure 5A:
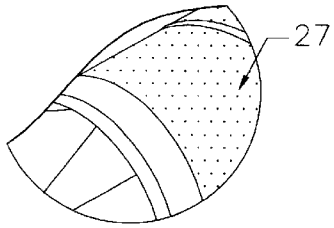
FIGS. 5. 5A, 6, 7, 8, 8A, and 8B show Isometric, Plan, Elevation and Side views of the attenuator with two ovoidal form passages.
Figure 5:
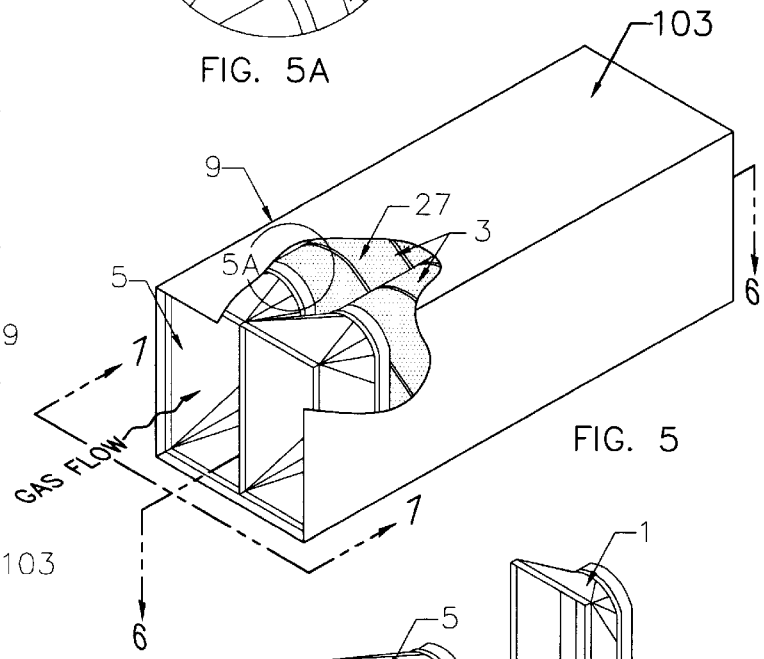
Figure 8A:
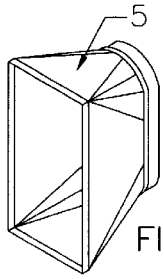
Figure 8B:
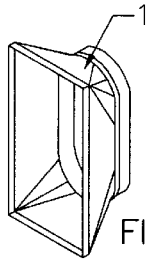
Figure 7:
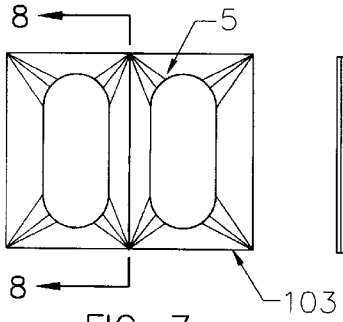
Figure 8:
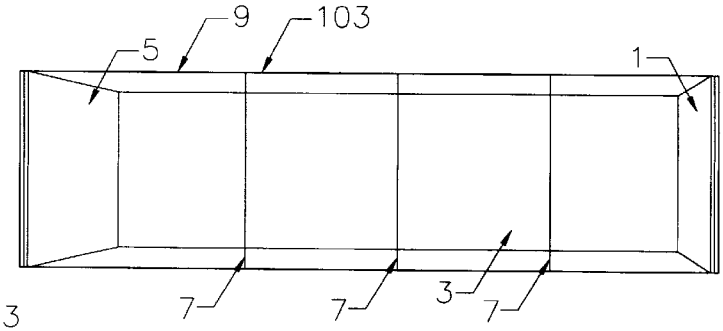

In FIGS. 5. 5A, 6, 7, 8, 8A, and 8B an alternate fibrous filler material free sound attenuator 103 without an expansion chamber 25 is illustrated. It includes the same parts as the fibrous filler material free sound attenuator 101 except there is no expansion chamber 25.

In FIGS. 9, 9A, 10, 11, 12, 12A, and 12B a second alternate fibrous filler material free sound attenuator 105 with the expansion chamber 25 and a single ovoidal form passage 3 is illustrated. As can be seen from the FIG. 9, the ovoidal form passage has a share that essentially has two parallel sides with rounded ends. It includes a single entrance transition 39, the ovoidal form passage 3, the ovoidal form perforated sheet 27, the outer shell box 9, divider plates 7, and a single exit transition 37.

In FIGS. 13, 13A, 14, 15, 16, 16A, and 16B, a third alternate fibrous filler material free sound attenuator 107 without the expansion chamber 25 and having one ovoidal form passage 3 is illustrated. It includes an entrance transition 39, the ovoidal form passage 3, the ovoidal form perforated spiral sheet 27, the outer shell box 9, divider plates 7, and a single exit transition 37.

In FIGS. 17, 17A, 18, 19, 20, 20A, and 20B, a fibrous filler material free sound attenuator 109 with the expansion chamber 25 and having one round passage 36 is illustrated. It includes a round entrance transition 35, the round passage 36, the round perforated spiral sheet 28, the outer shell box 9, divider plates 7, and a round exit transition 33

In FIGS. 21, 21A, 22, 23, 24, 24A, and 24B, a fourth alternate fibrous filler material free sound attenuator 111 without the expansion chamber 25 and having one round passage 36 is illustrated. It includes the round entrance transition 35, one round passage 36, the round perforated spiral sheet 28, the outer box shell 9, divider plates 7, and the round exit transition 33.

In FIGS. 25, 25A, 26, and 27, a round fibrous filler material free sound attenuator 113 with a round spiral outer shell 15 and an annular perforated passage spiral duct 17 is illustrated. There is a perforated bullet 21 in the center of the attenuator 113 with z-trims 19 attaching it within the annular perforated passage spiral duct 17. The bullet 21 has solid nose cones 29 on both ends. The perforated bullet 21 further reduces machinery and gas flow noise in this embodiment of the present invention.

Figure 29:
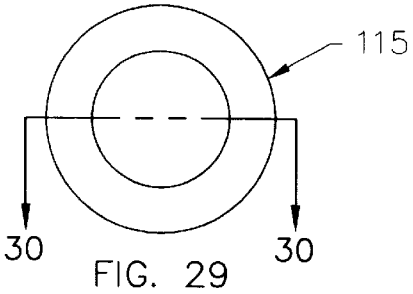
FIGS. 28, 29, and 30 show Isometric, Elevation and Plan views of the round attenuator with a round passage without a bullet inside the attenuator.
Figure 30:
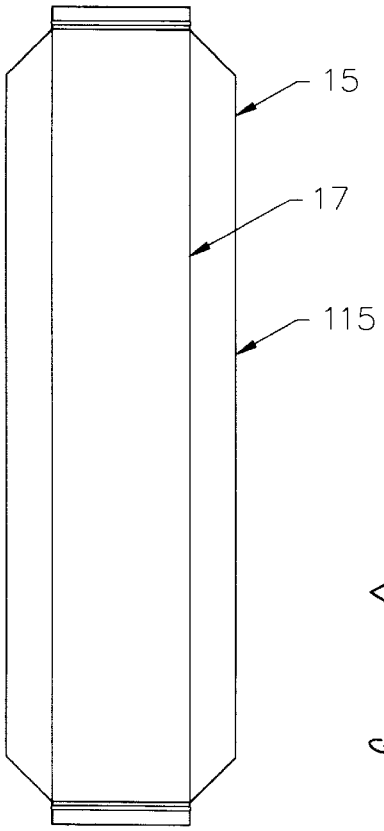
Figure 28:
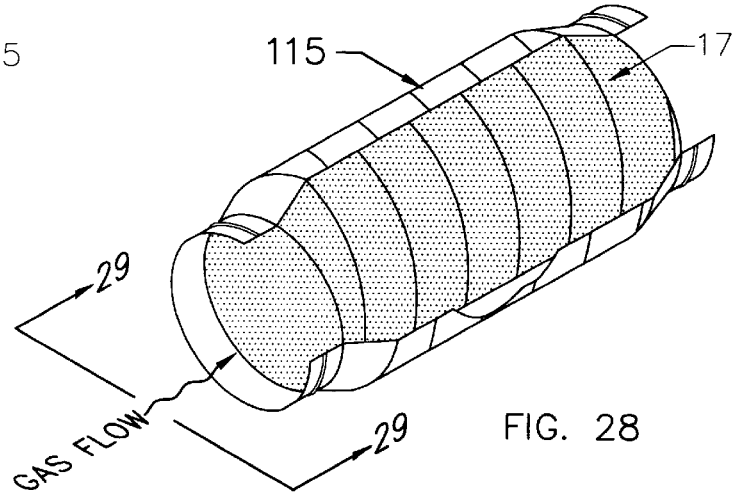
Figure 32:
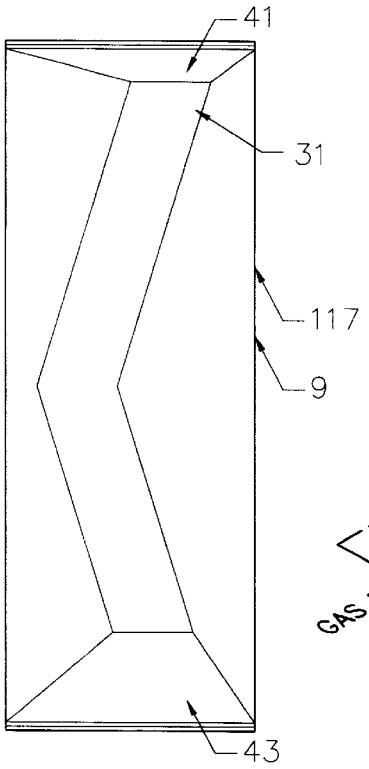
FIGS. 31, 31A, 32, 33, 34, 34A, and 34B show Isomatric, Plan, Elevation, and Side views of an attenuator with a single no-line-of-sight ovoidal form passage.
Figure 31A:
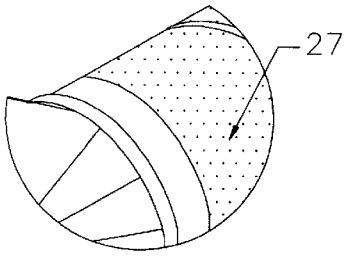
Figure 31:
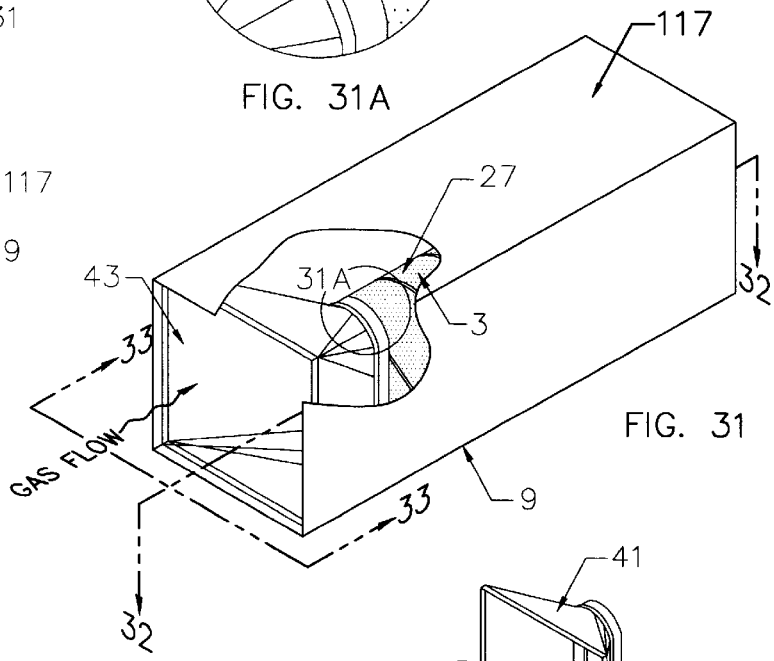
Figure 34B:
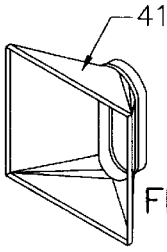
Figure 34A:
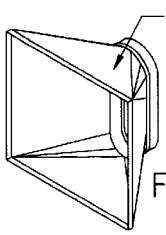
Figure 33:
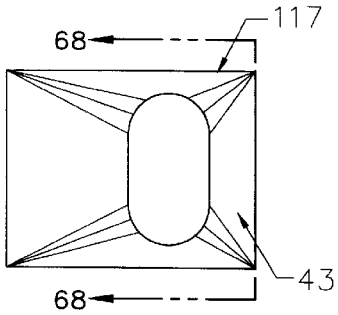
Figure 34:
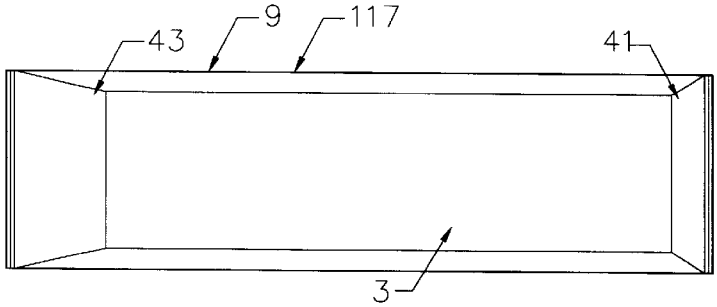

In FIGS. 28, 29, and 32, an alternate round fibrous filler material free sound attenuator 115 with a round spiral outer shell 15 and an annular perforated passage spiral duct 17 is illustrated.

FIGS. 31, 31A, 32, 33, 34, 34A, and 34B depict a rectangular fibrous filler material free sound attenuator 117 without a line of sight. The attenuator 117 has a ovoidal form passage 3 that has a bend 31 inside the attenuator 117 in such a way that the other end of the attenuator 117 can not be seen from one end of the attenuator 117. The attenuator 117 has the outer shell box 9, an offset entrance transition 43, the nvoidal form passage 3, a ovoidal form perforated spiral sheet 27, and an offset exit transition 41.

In FIGS. 35, 35A, 36, 37, 38, 38A, and 38B, a fifth alternate fibrous filler material free sound attenuator 119 having three ovoidal form passages 3 is illustrated. It differs from the alternate fibrous filler material free sound attenuator 103 illustrated in FIGS. 5 to 8 in that there are three ovoidal form passages 3.

In FIGS. 39, 39A, 40, 41, 42, 42A, and 42B, a rectangular fibrous filler material free sound attenuator 121 with two ovoidal form passages 3A at the entrance and converying to a single ovoidal form passage 3B is illustrated. It includes the entrance transition 1, an ovoidal form exit transition 47, a transition 23 that changes from the two passages 3A to single passage 3B, divider plates 7, the outer shell box 9, and the ovoidal form perforated spiral sheet 27. This embodiment of the present invention further reduces machinery and gas flow noise.

Figure 10:
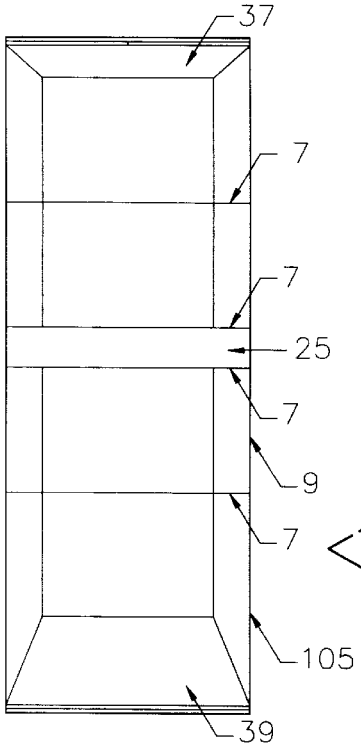
FIGS. 9, 9A, 10, 11, 12, 12A, and 12B show Isometric, Plan, Elevation and Side views of the attenuator with a single ovoidal form passage with an expansion chamber in it.
Figure 9A:
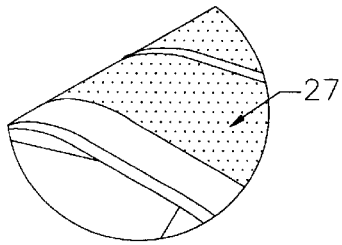
Figure 9:
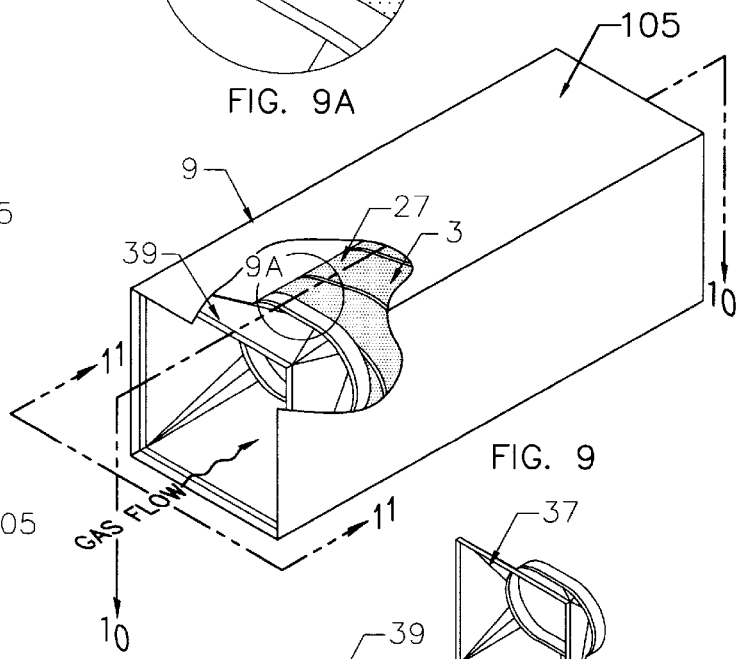
Figure 12B:
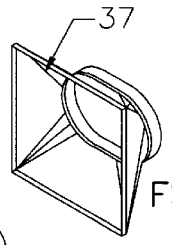
Figure 12A:
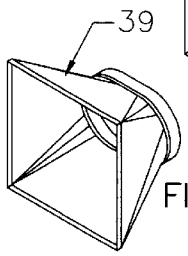
Figure 11:
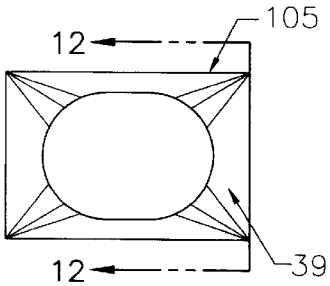
Figure 12:
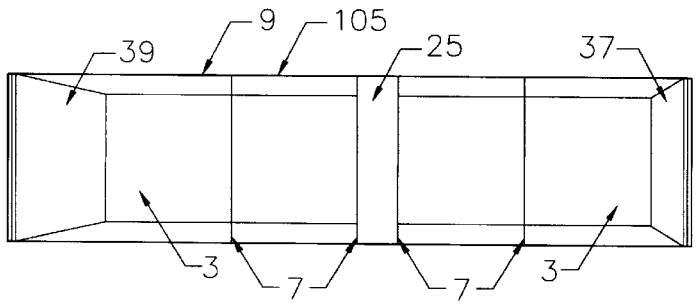
Figure 14:
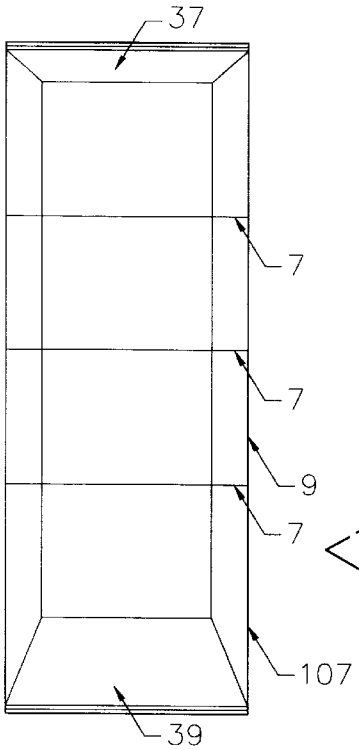
FIGS. 13, 13A, 14, 15, 16, 16A, and 16B show Isometric, Plan, Elevation and Side views of the attenuator with the single ovoidal form passage.
Figure 13A:
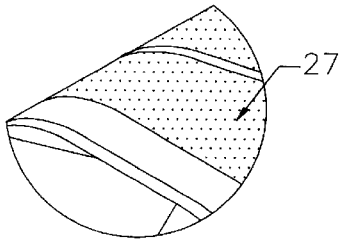
Figure 13:
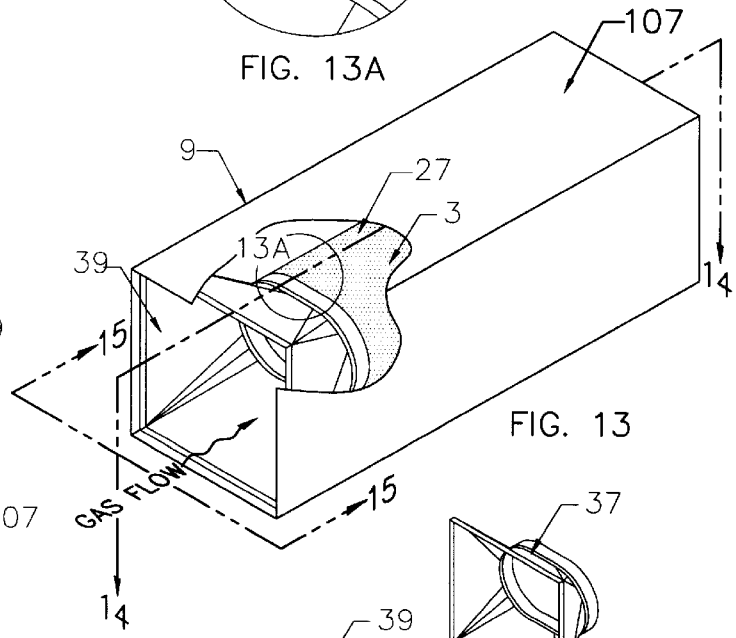
Figure 16B:
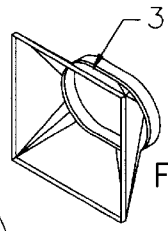
Figure 16A:
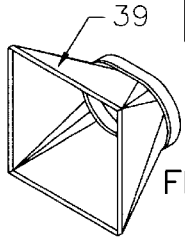
Figure 15:
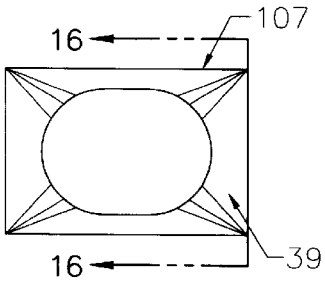
Figure 16:
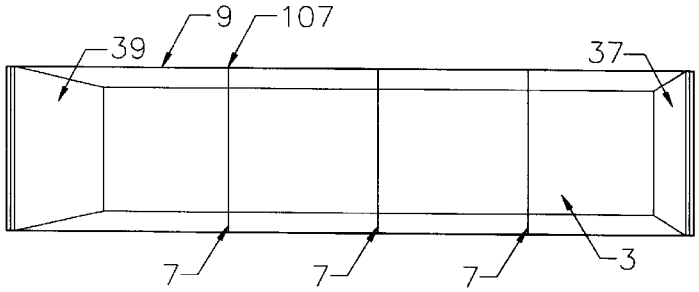
Figure 18:
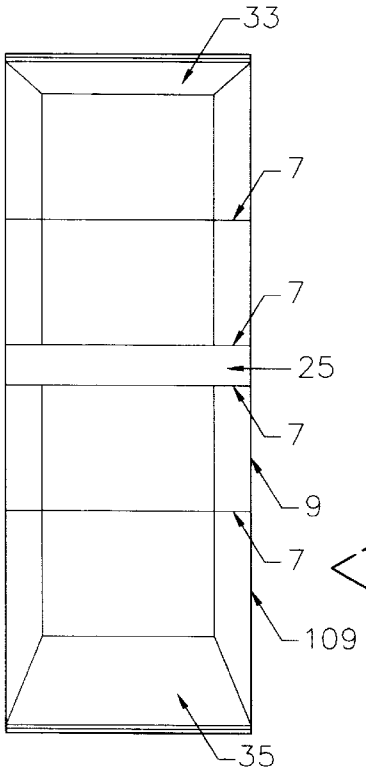
FIGS. 17, 17A, 18, 19, 20, 20A, and 20B show Isometric, Plan, Elevation and Side views of the attenuator with the single round passage with an expansion chamber.
Figure 17A:
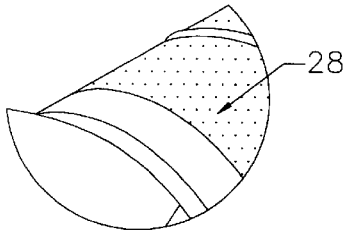
Figure 17:
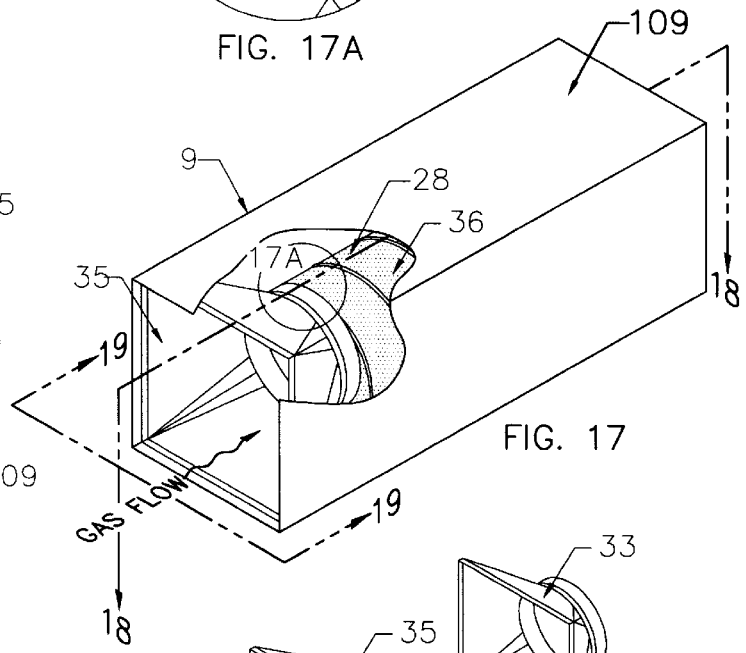
Figure 20A:
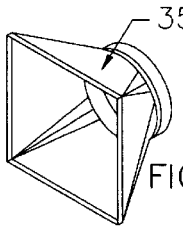
Figure 20B:
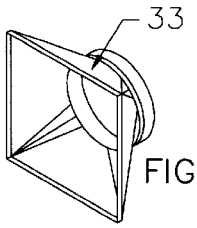
Figure 19:
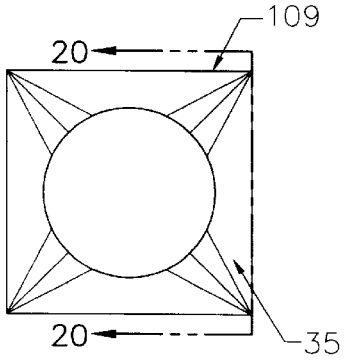
Figure 20:
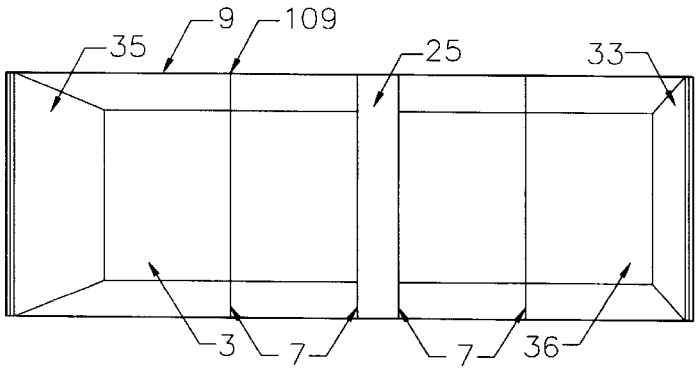
Figure 22:
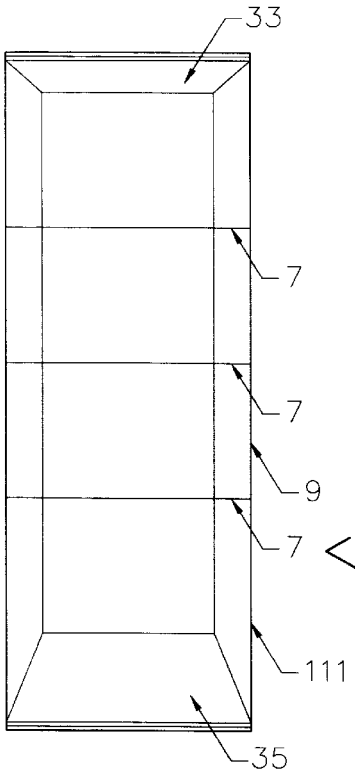
FIGS. 21, 21A, 22. 23. 24, 24A, and 24B show Isometric, Plan, Elevation and Side views of the attenuator with a single round passage.
Figure 21A:
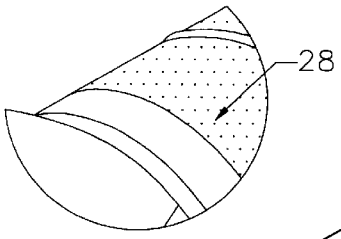
Figure 21:
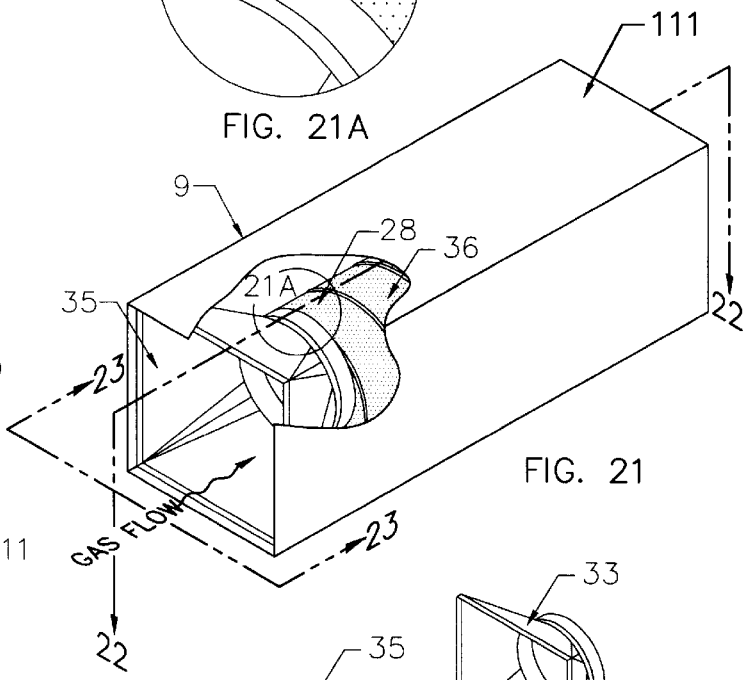
Figure 24A:
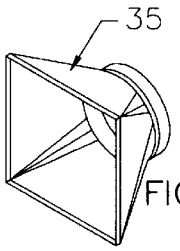
Figure 24B:
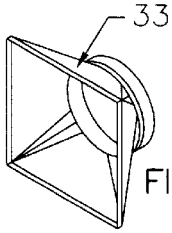
Figure 23:
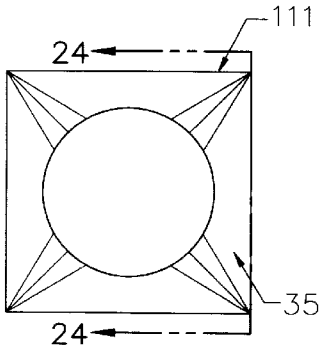
Figure 24:
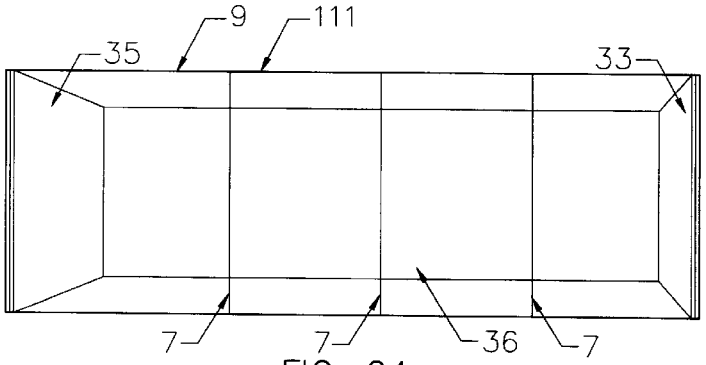
Figure 26:
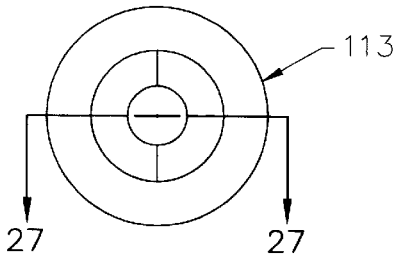
FIGS. 25, 25A, 26, and 27 show Isometric, Elevation, and Plan views of a round attenuator with an annular passage with a bullet inside the attenuator.
Figure 27:
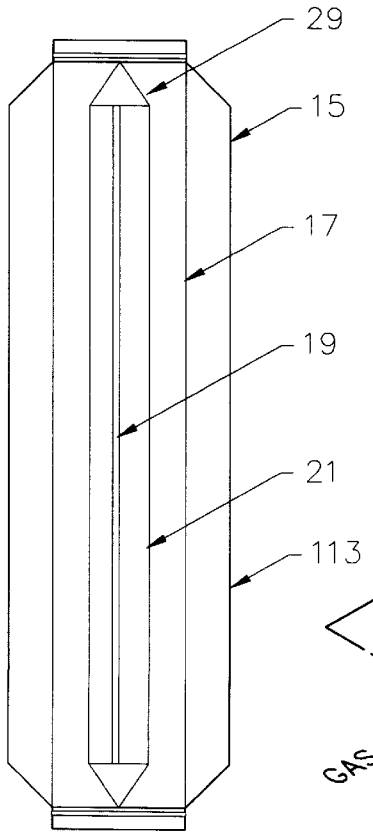
Figure 25A:
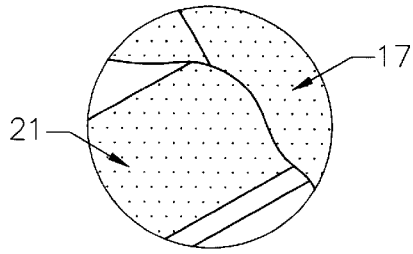
Figure 25:
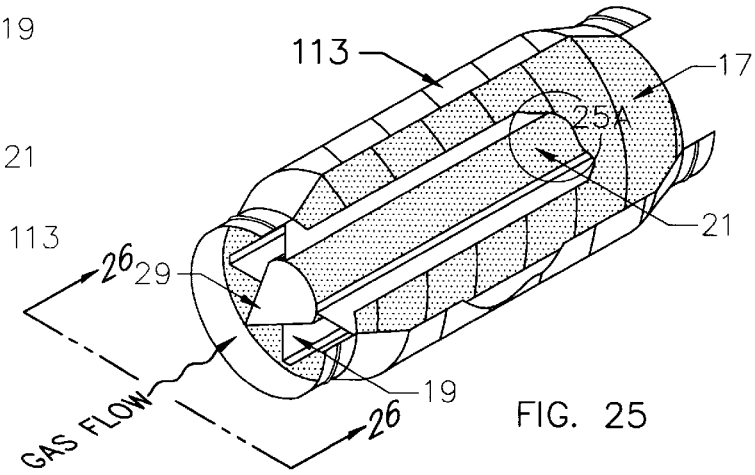
Figure 40:
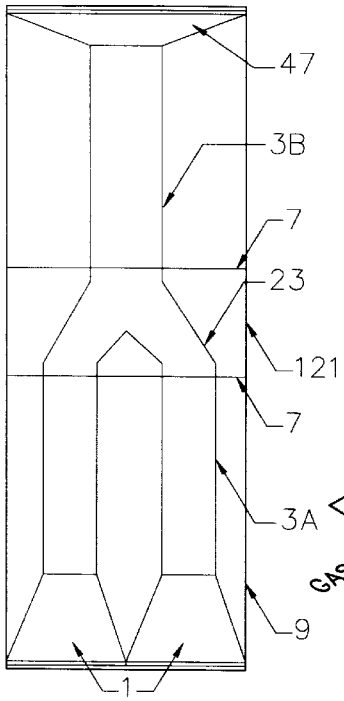
FIGS. 39, 39A, 40, 41, 42, 42A, and 42B show Isometric, Plan, Elevation, and Side views of an attenuator with two ovoidal form passages converging to a single ovoidal form passage inside the attenuator, thus providing a gas flow passage that has two passages in the beginning which change into one.
Figure 39A:
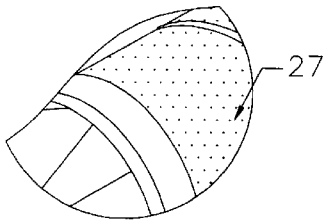
Figure 39:
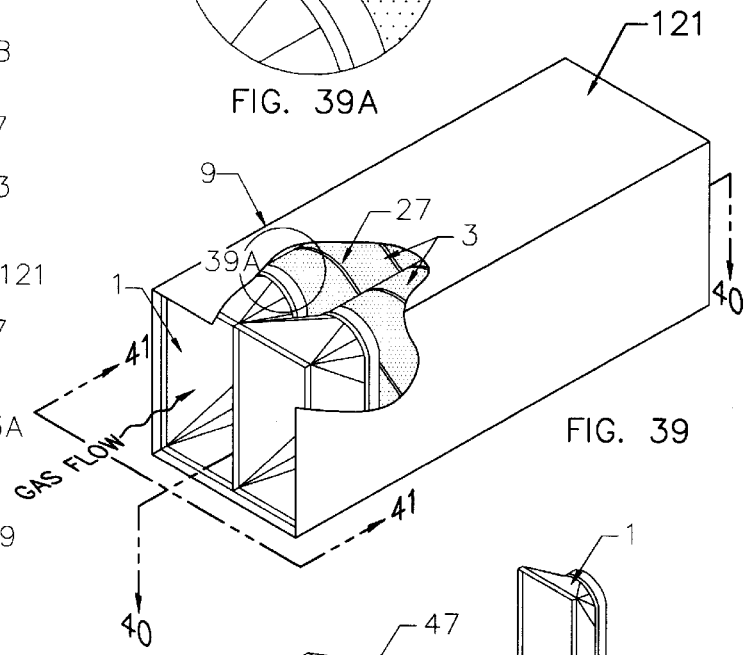
Figure 42B:
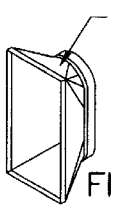
Figure 42A:
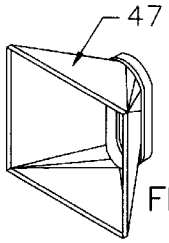
Figure 41:
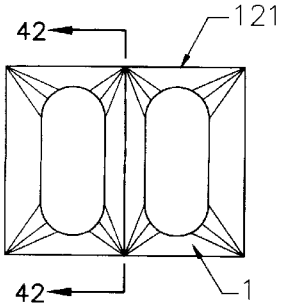
Figure 42:
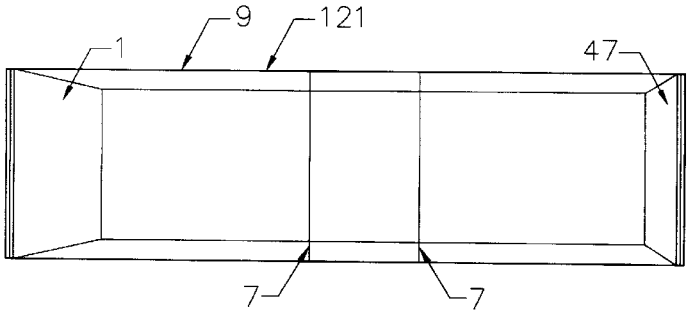

Ovoidal form passages 3, 3A, and 3B such as are shown in various figures such as FIGS. 10 and 40, as well as the annular perforated passage duct 17 as shown in FIG. 25 are a significant advance in reducing machinery and gas flow noise in duct systems. Aside from sound attenuation, there is also a reduction in flow turbulence. The transitions enumerated in this description, such as the entrance transition 5 and the exit transition 1 as shown in FIGS. 4A and 4B, reduce turbulence of flow by providing a transition from a rectangular duct leading into the present invention to the ovoidal form or round shape of the passage or duct. This reduction in turbulence not only reduces noise, it also reduces pressure drop from flow through various attenuators described in this specification. Reducing pressure drop means less horsepower is required to maintain a given flow of gas, such as air, throuh a a duct system. So, incorporating the present invention in a duct system not only reduces noise, it also saves energy.

Although the description above contains many specificities, these should not be construed as limiting the scope of the invention but as merely providing illustrations of some of the presently preferred embodiments of this invention. For example, gas flow is mentioned, but as obvious to anyone skilled in the state of the art, this invention applies to air, which is a mixture of gases. Also, while the preferred embodiment of the present invention incorporates perforated spiral sheets to form passageways, flat sheet will produce some sound attenuation, but not as much as the spiral sheets.

Thus the scope of the invention should be determined by the appended claims and their legal equivalents, rather than by the examples given.

We claim:

1. A fibrous filler material free sound attenuator, for attenuating sound in gas flow comprising:

a) a shell encompassing and supporting components including at least one ovoidal form passage formed from perforated sheet for the flow of said gas, and b) divider plates between the shell and the ovoidal form passage forming cavities to contain gas from the gas stream passing through the fibrous filler material free sound attenuator, said gas passing through the perforated sheet of the ovoidal form passage.

2. The fibrous filler material free sound attenuator of claim 1 further comprising at least one entrance transition which is encompassed and supported by the shell, said entrance transition directing gas flow from an adjacent rectangular duct through the ovoidal form passage to reduce gas flow turbulence through the fibrous filler material free sound attenuator.

3. The fibrous filler material free sound attenuator of claim 1 wherein the ovoidal form passage contains a gap which serves as an expansion chamber, said expansion chamber being a discontinuity that adds to the sound attenuation by reflecting noise in lower frequencies.

4. The fibrous filler material free sound attenuator of claim 1 wherein the ovoidal form passage is formed from a perforated spiral sheet.

5. The fibrous filler material free sound attenuator of claim 1 wherein the shell is rectangular.

6. The fibrous filler material free sound attenuator of claim 2 wherein the entrance transition is an offset entrance transition and the ovoidal form passage formed by the ovoidal form perforated sheet for the flow of said gas has a bend inside said attenuator so that an end of the attenuator cannot be seen from the other so the attenuator is without a line of sight.

7. The fibrous filler material free attenuator of claim 1 further comprising two ovoidal form passages formed by perforated sheet at an entrance converging to a transition to which is attached a single ovoidal form passage formed by a perforated sheet.

8. The fibrous filler material material free sound attenuator of claim 1 wherein at least one of the ovoidal form passages is formed by a perforated spiral sheet.

9. The fibrous filler material free sound attenuator of claim 2 further comprising at least one exit transition encompassed by and supported by the shell, said exit transition providing for a connection from said attenuator to an existing rectangular or square duct.

10. A sound attenuator for attenuating sound in a duct comprising:

a) a shell encompassing and supporting components including at least one ovoidal air passage, said shell including an air entrance and an air exit; and b) divider plates forming cavities between said shell and said ovoidal passage, said ovoidal passage including perforations that allow for sound attenuation between said ovoidal passage and said cavities.

11. The sound attenuator of claim 10 wherein said passage is formed from a flat sheet of material spiraled about the direction of gas flow through said ovoidal passage.

12. A fibrous filler material free sound attenuator for attennuating sound in gas flow comprising a round spiral outer shell encompassing and supporting at least one ovoidal form passage perforated spiral duct for the flow of said gas.

* * * * *